US007909525B2

(12) United States Patent
Knäble et al.

(10) Patent No.: US 7,909,525 B2
(45) Date of Patent: Mar. 22, 2011

(54) ARTICLE, IN PARTICULAR A WRITING IMPLEMENT, HAVING A GRIPPING ZONE WITH RAISED STRUCTURES

(75) Inventors: Thomas Knäble, Nürnberg (DE); Gerhard Lugert, Nürnberg (DE)

(73) Assignee: Faber-Castell AG, Stein (DE)

( * ) Notice: Subject to any disclaimer, the term of this patent is extended or adjusted under 35 U.S.C. 154(b) by 1131 days.

(21) Appl. No.: 11/598,615

(22) Filed: Nov. 13, 2006

(65) Prior Publication Data

US 2007/0110497 A1 May 17, 2007

(30) Foreign Application Priority Data

Nov. 11, 2005 (DE) ..... 20 2005 017 780 U

(51) Int. Cl.
*A46B 5/02* (2006.01)

(52) U.S. Cl. ..... 401/6; 16/430

(58) Field of Classification Search ..... 401/6, 7; 16/430

See application file for complete search history.

(56) References Cited

U.S. PATENT DOCUMENTS

| | | | | |
|---|---|---|---|---|
| 4,832,604 | A * | 5/1989 | Rusk | 434/166 |
| 5,122,430 | A | 6/1992 | Nishitsuji et al. | |
| 6,056,462 | A | 5/2000 | Fukai et al. | |
| 6,158,910 | A | 12/2000 | Jolly et al. | |
| 6,164,855 | A | 12/2000 | Perry et al. | |
| 6,375,373 | B2 | 4/2002 | Izushima | |
| 6,447,190 | B1 * | 9/2002 | Kwitek | 401/6 |
| 6,461,067 | B1 | 10/2002 | Beck et al. | |
| 6,837,637 | B1 | 1/2005 | Beck et al. | |
| 6,942,408 | B2 * | 9/2005 | Smith | 401/6 |
| 2002/0098029 | A1 | 7/2002 | Beck et al. | |
| 2004/0190973 | A1 | 9/2004 | Nakayama et al. | |
| 2006/0147245 | A1 | 7/2006 | Cetera | |
| 2006/0204743 | A1 | 9/2006 | Beck et al. | |

FOREIGN PATENT DOCUMENTS

| | | | |
|---|---|---|---|
| CN | 2139518 | Y | 8/1993 |
| CN | 2406824 | Y | 11/2000 |
| CN | 1303332 | A | 7/2001 |
| CN | 1350491 | A | 5/2002 |
| DE | 203 14 274 | U1 | 7/2004 |
| EP | 0376322 | A2 | 7/1990 |
| EP | 1 177 108 | B1 | 5/2003 |
| EP | 1 700 713 | A1 | 9/2006 |
| GB | 1 442 823 | | 7/1976 |
| JP | 09039467 | | 2/1997 |
| WO | 99/48702 | | 9/1999 |
| WO | 9948702 | A1 | 9/1999 |
| WO | 0068023 | A1 | 11/2000 |

* cited by examiner

*Primary Examiner* — David J Walczak

(74) *Attorney, Agent, or Firm* — Laurence A. Greenberg; Werner H. Stemer; Ralph E. Locher

(57) ABSTRACT

An article, in particular a writing implement, has a gripping zone with raised structures. In which case, in a region of the gripping zone, the article is coated with a film which has the raised structures on its surface. In particular, the adherence of the raised structures to the surface of the article is improved.

6 Claims, 3 Drawing Sheets

FIG.3
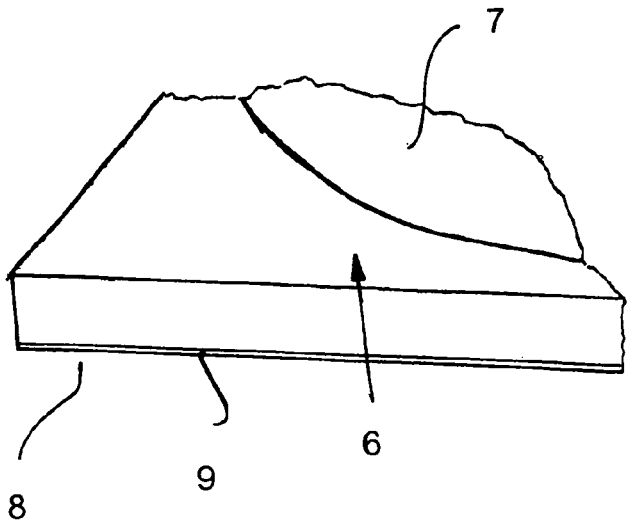
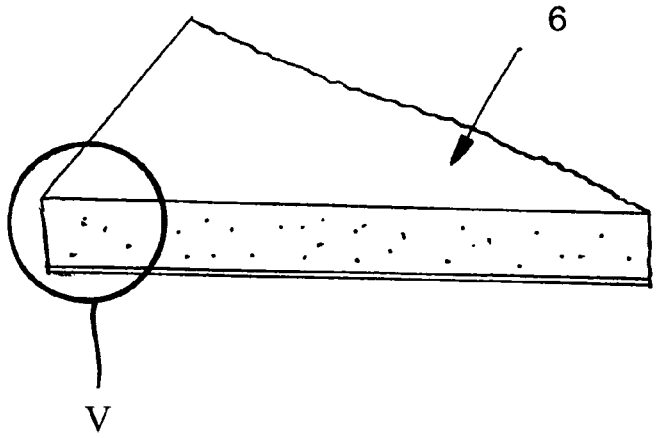
FIG.4
FIG.5
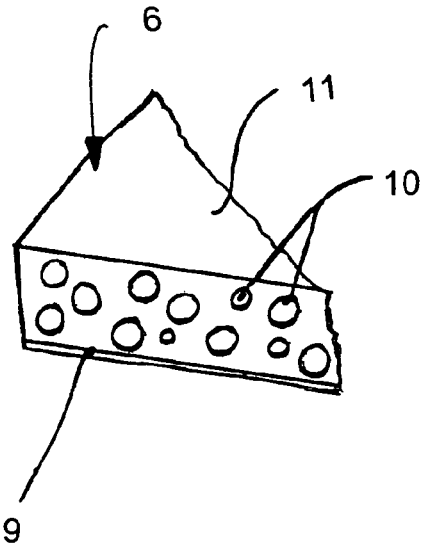

ARTICLE, IN PARTICULAR A WRITING IMPLEMENT, HAVING A GRIPPING ZONE WITH RAISED STRUCTURES

CROSS-REFERENCE TO RELATED APPLICATION

This application claims the priority, under 35 U.S.C. §119, of German Utility Model application DE 20 2005 017 780.6, filed Nov. 11, 2005; the prior application is herewith incorporated by reference in its entirety.

BACKGROUND OF THE INVENTION

Field of the Invention

The invention relates to an article, in particular a writing implement having a gripping zone on which raised structures are provided in order to improve the grip and the handling. Such structures usually are formed by a non-slip and possibly also sweat-absorbing material, mostly based on plastics. The material of the raised structures also has to meet further requirements, for example, in respect of visual appearance, durability and safeness from a toxicological point of view. Furthermore, the material of the raised structures also has to be of such a nature that it adheres firmly to the surface of the article. The surfaces of the articles, for example, used on a daily basis are of very different configurations, for example they are of natural wood, painted wood, metal or various plastics. It is thus often difficult to select a material for raised structures that satisfactorily combines with all of these material properties. Problems often also arise in applying the raised structures, in particular if the articles are of irregular shape.

SUMMARY OF THE INVENTION

It is accordingly an object of the invention to provide an article, in particular a writing implement, having a gripping zone with raised structures that overcomes the above-mentioned disadvantages of the prior art devices of this general type, which is improved, in particular, in the adherence of the raised structures to the surface of the article.

With the foregoing and other objects in view there is provided, in accordance with the invention, an article. The article contains an article body having a gripping zone, and a film coating the article body in a region of the gripping zone. The film has a surface with raised structures disposed on the surface.

In the region of the gripping zone, the article is coated with a film that has the raised structures on its surface. Since the haptic properties of the gripping zone are defined by the raised structures, the material of the film may be selected primarily such that the material of the raised structures adheres well to it. In respect of the adherence of the film to the surface of the article, the problems are on a considerably smaller scale than in the case of the raised structures themselves. This is because the film is connected to the gripping region of the article over a large surface area, so that, in relation to a surface-area unit of the film, a lower retaining force is necessary than, for example, in the case of a structure with protuberances. Added to this is the fact that there are a multiplicity of adhesives available which are suitable for more or less any desired material combinations. It is therefore irrelevant as to whether the article if formed of wood, of plastic or of metal. For processing reasons alone, the use of an adhesive technique is scarcely viable for raised structures.

In the case of a further preferred exemplary embodiment, the film, rather than being adhesively bonded, is a shrink film. Such a film can be used, in particular, for cylindrical articles such as pencils, handles of playthings and the like. In these case, a tubular shrink film is pushed over the gripping zone and shrink-fitted under the action of temperature, so that it then butts firmly against the outer circumference of the article or of the gripping zone.

The raised structures can be produced in a variety of different ways for an article according to the invention. In the first instance, conventional techniques are conceivable here, for example by the raised structures being applied to the film in the form of an initially free-flowing and subsequently solidifying plastic substance. Raised structures that are preferred here are ones that are formed substantially from a water-based polymer dispersion that cures to be water-resistant. Pencils with such structures are known from European patent EP 1 177 108 B1 (corresponding to U.S. patent disclosure No. 2002/0098029 A2), which is herewith incorporated by reference in the application. An alternative way of producing the raised structures is described in German Utility Model 203 14 274.8 (corresponding to U.S. Pat. No. 6,837,637), the disclosure contents of which are likewise herewith incorporated herein: in order to produce the raised structures, use is made of a preparation which contains a radiation-curable plastic. Use is preferably made of such a plastic that can be cured with the aid of UV light.

In the case of a further preferred configuration, the raised structures are formed integrally with the film. Such a film may be formed, for example, by a stamping die, which has cavities complementing the raised structures present in its die surface, being pressed, possibly under the action of temperature, onto a region of the film that corresponds to a gripping zone. Film material is then forced into these cavities by the stamping operation. It is also conceivable, however, for a raised structure or protruding film regions to be produced with the aid of stamping carried out from the rear side of a film. The rear side here is that side of the film which is to be fixed on the surface of a gripping zone.

In the case of a further preferred exemplary embodiment, it is provided that the film is a plastic film containing expandable particles, the raised structures being formed by film regions with expanded particles. The raised structures can be produced either prior to the article being coated with the film or after the article has been coated with the film. In both cases, certain areas of the film are treated, for example brought into contact with a heated body, such that the expandable particles end up expanding. On account of the larger amount of volume required, the material in the treated areas protrudes out of the film surface. Thermally expandable particles, in particular hollow micro-spheres formed of plastic, are particularly preferred. These contain inside them a liquid that is capable of evaporating. During heating, the polymer material and the hollow micro-spheres are inflated to a multiple of their original size by the evaporating liquid. The expanding hollow micro-spheres thus result in an increase in volume in the coating in the thermal-treatment regions, raised structures or raised surface regions forming as a result. A process for producing raised structures with the aid of expandable particles is described in published, European patent application EP 05 005 101.0-2113 which is incorporated herein by reference.

Other features which are considered as characteristic for the invention are set forth in the appended claims.

Although the invention is illustrated and described herein as embodied in an article, in particular a writing implement, having a gripping zone with raised structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a diagrammatic, perspective view of a detail of a film with a raised structure located on it;

FIG. 4 is a diagrammatic, perspective view of a detail of a plastic film which contains expandable particles;

FIG. 5 is a diagrammatic, perspective view of detail V shown in FIG. 4.

DESCRIPTION OF THE PREFERRED EMBODIMENTS

Figure 1:
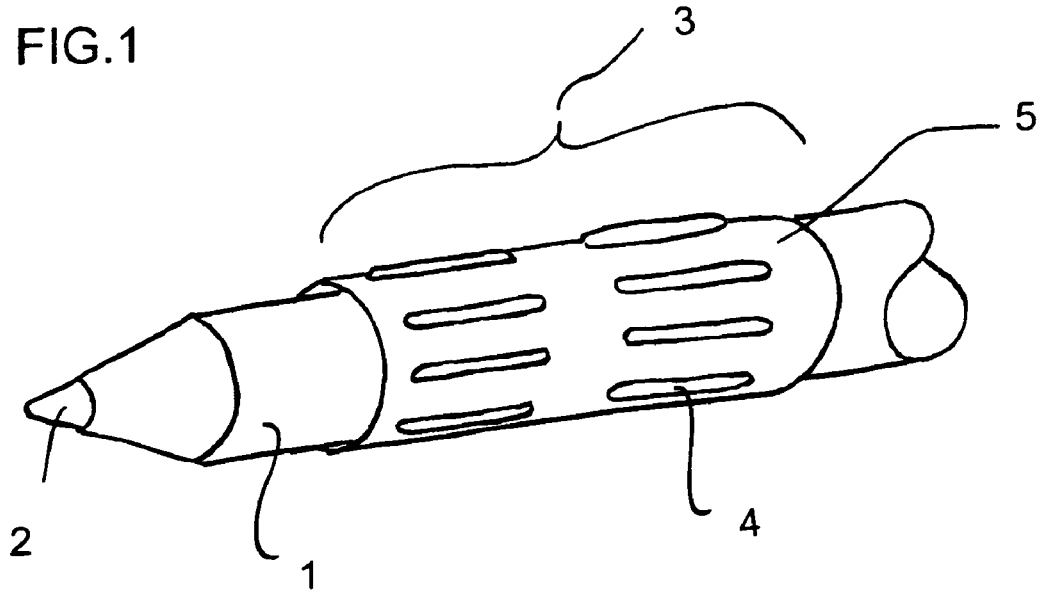
FIG. 1 is a diagrammatic, perspective view of a wood-encased pencil in which a gripping zone is produced with an aid of a shrink film according to the invention.

Referring now to the figures of the drawing in detail and first, particularly, to FIG. 1 thereof, there is shown, as an example of an article, a pencil with a wooden casing 1 containing a core 2. A gripping zone 3 with raised structures in the form of ribs 4 extending in the longitudinal direction of the pencil is provided on a circumferential surface of the wooden casing 1, the circumferential surface being provided, for example, with a coating of paint. The ribs 4, rather than being provided directly on the pencil surface, are provided on a shrink film 5 which, in a state of prefabrication, loosely encloses the subsequent gripping zone, as is shown in FIG. 1. During heating, the film contracts and then adheres firmly to the pencil surface. The ribs 4 need not necessarily be provided on the shrink film. They may also be produced subsequently by conventional processes, for example in accordance with European patent EP 1 177 108 B1 or published, non-prosecuted German patent application DE 203 14 274.8. A shrink film is a cold-stretched thermoplastic film, for example based on PETP, PE or PVC.

Figure 2:
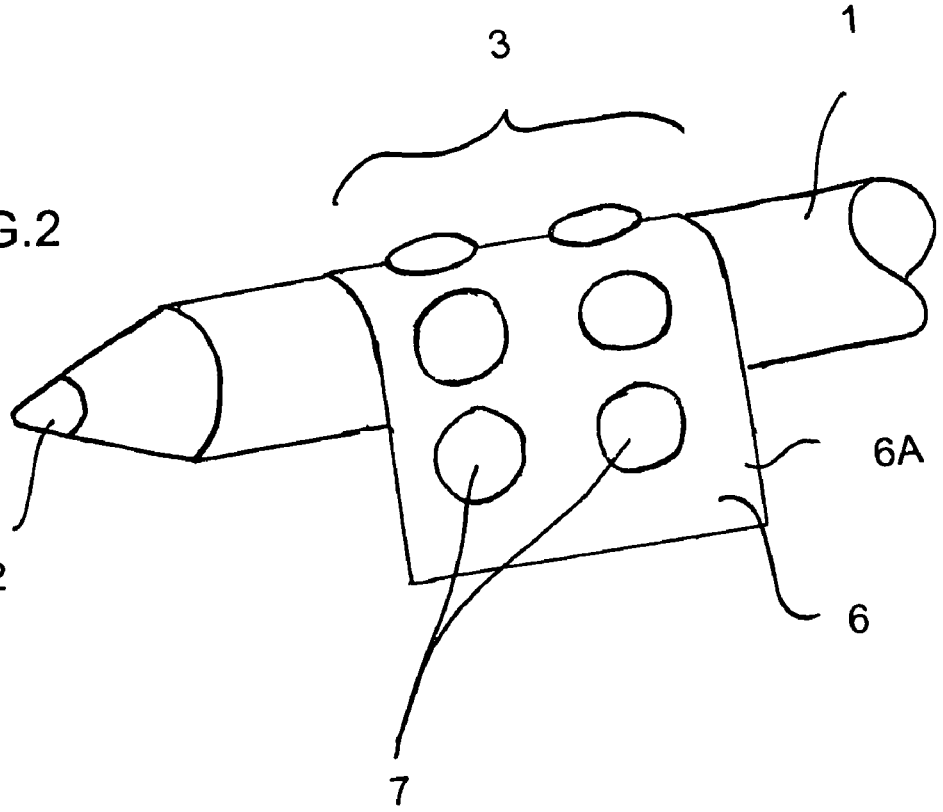
FIG. 2 is a diagrammatic, perspective view corresponding to FIG. 1 of the pencil in which the gripping zone is produced in an alternative manner.

A further possible way of producing the gripping zone 3 is indicated in FIG. 2. Here, a blank 6*a* of a film 6 is wound around a pencil-surface region forming the subsequent gripping zone 3 and is fixed thereon, for example, by adhesive bonding. It is particularly expedient in such a procedure for the raised structures—which in the present case are protuberances 7—to be produced before the film 6 is applied, rather than being applied to the article itself. This is because the task of applying raised structures to planar films 6 can be carried out considerably more easily than the task of applying them to articles having gripping zones with often complicated curvature. Large film surfaces can easily be provided with raised structures in an extremely short period of time, for example, by screen printing. Examples of possible films are those made of PE, PVC, PA, PC and the like.

Adhesive bonding is preferably a possible way of fixing a film 6 of the abovementioned type on the surface of an article. For this purpose, the film is provided with an adhesive layer 9 on its rear side 8 as shown in FIG. 3. FIG. 4 shows a film 6 that contains expandable particles with an average size of 2 μm to 45 μm. Use is preferably made of so-called hollow micro-spheres. These are spherical particles that contain inside them a liquid that can easily be evaporated. If, then, an area of a film is heated, for example, by direct thermal contact with the aid of a die or by radiation, for example infrared radiation, the liquid evaporates, as a result of which the hollow micro-spheres inflate. The inflation is made possible by the polymer material used being a thermoplastic. Hollow micro-spheres of the type mentioned above are available, for example, under the trade name "Expancel 551 DU40" from Akzo Nobel Chemicals GmbH, D-46446 Emmerich. Expanded hollow micro-spheres 10 increase the volume of a heated area of the film 6 such that, in the area, the film material goes beyond the film surface and forms a raised structure. The operations of heating and expanding the hollow micro-spheres best take place on the article itself since, here, the film 6 is fixed to the surface of the article, so that the increase in volume can cause a protrusion to form only on a top side 11, but not on the rear side 8, of a film.

Figure 6:
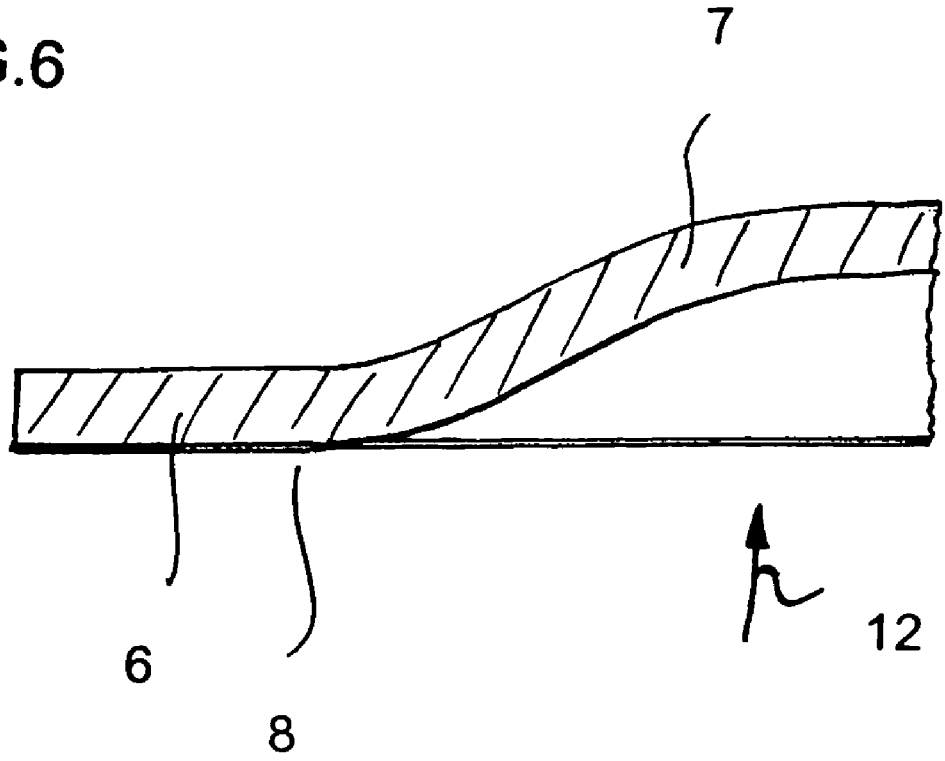
FIG. 6 is a diagrammatic, sectional view of a detail of a film with integrally formed raised structures.

FIG. 6 shows the film 6 in which raised structures, for example in the form of protuberances 7, are formed by a non-illustrated stamping tool being forced in from the rear side 8 of the film 6 in arrow direction 12, a female die with complementary cavities possibly being used for abutment purposes. Use is expediently made here of a fill material made of thermoplastic and the stamping operation is carried out under increased temperature.

We claim:

1. A method for producing a writing utensil with a grip formed with elevated structures, the method which comprises:

providing a writing utensil with a gripping zone having a surface;

providing a film with given areas bulged out by stamping;

forming the bulged-out film areas by stamping a back side of the film that is to be affixed to the surface of the writing utensil; and affixing the film to the surface of the writing utensil.

2. The method according to claim 1, wherein the affixing step comprises fixing the film onto the surface of the writing utensil with an adhesive.

3. The method according to claim 1, wherein the film is shrinking film and the affixing step comprises shrinking the film onto the writing utensil.

4. A method for producing a writing utensil with a grip formed with elevated structures, the method which comprises:

providing a writing utensil with a gripping zone having a surface;

providing a film with given areas bulged out by stamping;

pressing a stamping die onto an area of the film corresponding to the grip, the stamping die having a stamping surface formed with recesses complementary to the elevated structures; and affixing the film to the surface of the writing utensil.

5. The method according to claim 4, wherein the affixing step comprises fixing the film onto the surface of the writing utensil with an adhesive.

6. The method according to claim 4, wherein the film is shrinking film and the affixing step comprises shrinking the film onto the writing utensil.

* * * * *